US008801505B2

(12) United States Patent
Smith

(10) Patent No.: US 8,801,505 B2
(45) Date of Patent: Aug. 12, 2014

(54) ABRADING DEVICE AND METHOD OF ABRADING A FLOOR STRUCTURE UTILIZING THE SAME

(75) Inventor: W. Steven Smith, Cornelius, NC (US)

(73) Assignee: AWI Licensing Company, Wilmington, DE (US)

( * ) Notice: Subject to any disclaimer, the term of this patent is extended or adjusted under 35 U.S.C. 154(b) by 536 days.

(21) Appl. No.: 12/825,448

(22) Filed: Jun. 29, 2010

(65) Prior Publication Data

US 2011/0318993 A1 Dec. 29, 2011

(51) Int. Cl.
*B24B 21/12* (2006.01)

(52) U.S. Cl.
USPC ..... 451/300; 451/299; 451/303; 451/304

(58) Field of Classification Search
USPC ..... 451/299, 300, 303, 304, 296, 57, 59, 451/65; 144/134.1, 359
See application file for complete search history.

(56) References Cited

U.S. PATENT DOCUMENTS

| | | | | |
|---|---|---|---|---|
| 1,374,194 | A | 4/1921 | Furber | |
| 1,669,989 | A * | 5/1928 | Madsen | 451/130 |
| 1,927,330 | A * | 9/1933 | Williams | 451/300 |
| 2,162,279 | A * | 6/1939 | Herchenrider | 451/301 |
| 2,231,921 | A * | 2/1941 | Kitlar et al. | 451/67 |
| 2,565,036 | A * | 8/1951 | MacDonald | 118/236 |
| 2,634,534 | A * | 4/1953 | Brown | 428/143 |
| 2,651,150 | A * | 9/1953 | De Florez et al. | 451/300 |
| 2,706,355 | A * | 4/1955 | Brown | 428/151 |
| 2,706,873 | A * | 4/1955 | Gifford | 451/299 |
| 2,720,061 | A * | 10/1955 | Anderson | 451/303 |
| 2,791,070 | A | 5/1957 | Schaller | |
| 3,074,210 | A * | 1/1963 | Eschenburg et al. | 451/300 |
| 3,081,159 | A * | 3/1963 | Brown | 427/274 |
| 3,146,556 | A | 9/1964 | Schuster | |
| 3,151,700 | A * | 10/1964 | Feid | 181/291 |
| 3,167,889 | A * | 2/1965 | Jacobi | 451/303 |
| 3,214,870 | A * | 11/1965 | Elmendorf | 451/28 |
| 3,299,921 | A * | 1/1967 | Jones | 144/375 |
| 3,339,319 | A | 9/1967 | Schuster et al. | |

(Continued)

FOREIGN PATENT DOCUMENTS

| | | |
|---|---|---|
| EP | 1053827 | 11/2000 |
| KR | 2009003769 A * | 1/2009 |

OTHER PUBLICATIONS

Homerwood, Experience the Sophistication of Authentic Amish Hand-crafted Hardwood; Brochure; 2008:12 pages.

*Primary Examiner* — Joseph J Hail
*Assistant Examiner* — Joel Crandall
(74) *Attorney, Agent, or Firm* — Amy M. Fernandez

(57) ABSTRACT

An abrading device for abrading a floor structure comprises a first abrading assembly and a second abrading assembly. The first and second abrading assemblies each have a rotationally driven contact roll provided with a sleeve having a plurality of cutouts formed in a pattern thereon. An abrading belt is trained over the sleeve. A first oscillation assembly is connected to the first abrading assembly and oscillates the contact roll of the first abrading assembly in a first direction via a linear reciprocating motion. A second oscillation assembly is connected to the second abrading assembly and oscillates the contact roll of the second abrading assembly in a second direction via a linear reciprocating motion. The first and second abrading assemblies consecutively abrade a top surface of the floor structure with the pattern formed by the cutouts on the respective sleeves to form a distressed visible pattern thereon.

20 Claims, 5 Drawing Sheets

(56) References Cited

U.S. PATENT DOCUMENTS

| | | | | | |
|---|---|---|---|---|---|
| 3,418,195 | A | * | 12/1968 | Allan | 428/114 |
| 3,553,899 | A | * | 1/1971 | Hasegawa | 451/303 |
| 3,616,103 | A | * | 10/1971 | Greiner et al. | 428/15 |
| 3,701,219 | A | * | 10/1972 | Sternal | 451/300 |
| 3,703,198 | A | * | 11/1972 | Luebs et al. | 144/24.1 |
| 3,961,108 | A | | 6/1976 | Rosner et al. | |
| 4,038,784 | A | | 8/1977 | Grivna | |
| 4,084,356 | A | * | 4/1978 | Brears | 451/59 |
| 4,361,986 | A | * | 12/1982 | van der Linden | 451/124 |
| 4,635,405 | A | | 1/1987 | Stump | |
| 4,742,650 | A | * | 5/1988 | Sauder et al. | 451/300 |
| 4,945,959 | A | * | 8/1990 | Biedenbach | 144/137 |
| 5,271,699 | A | * | 12/1993 | Barre et al. | 409/132 |
| 5,733,180 | A | * | 3/1998 | Kilde | 451/65 |
| 6,089,958 | A | | 7/2000 | Costa et al. | |
| 6,299,512 | B1 | * | 10/2001 | Costa et al. | 451/59 |
| 6,913,512 | B2 | * | 7/2005 | Grivna | 451/5 |
| 7,101,270 | B2 | | 9/2006 | Bau' et al. | |
| 7,198,557 | B2 | | 4/2007 | Haney | |
| 7,322,875 | B1 | * | 1/2008 | Lou | 451/8 |
| 8,051,886 | B2 | * | 11/2011 | Tappan et al. | 144/356 |
| 2004/0157539 | A1 | | 8/2004 | Stenftenagel et al. | |

* cited by examiner

ABRADING DEVICE AND METHOD OF ABRADING A FLOOR STRUCTURE UTILIZING THE SAME

FIELD OF THE INVENTION

The present invention relates to an abrading device for abrading a substantially planar wood structure, such as a solid hardwood or engineered hardwood floor structure, and a method of abrading the same.

BACKGROUND OF THE INVENTION

It is known to hand scrape a top surface of a floor structure, such as a solid hardwood or engineered hardwood floor structure, to create a distressed visible pattern on the top surface thereof. This process is both time consuming and costly, because each of the floor structures must be hand-sculpted one at a time. It is therefore desirable to develop an abrading device that can quickly and cost effectively abrade the top surface of the floor structure while still providing an authentic distressed appearance on the top surface thereof.

BRIEF SUMMARY OF THE INVENTION

The invention relates to an abrading device for providing a distressed visible pattern on a top surface of a floor structure comprising a first abrading assembly and a second abrading assembly. The first and second abrading assemblies each have a rotationally driven contact roll provided with a sleeve having a plurality of cutouts formed in a pattern thereon. An abrading belt is trained over the sleeve. A first oscillation assembly is connected to the first abrading assembly and oscillates the contact roll of the first abrading assembly in a first direction via a linear reciprocating motion. A second oscillation assembly is connected to the second abrading assembly and oscillates the contact roll of the second abrading assembly in a second direction via a linear reciprocating motion.

The invention further relates to a method for providing a distressed visible pattern on a top surface of a floor structure, comprising: providing a first abrading assembly and a second abrading assembly, the first and second abrading assemblies each having a rotationally driven contact roll, the contact roll being provided with a sleeve having a plurality of cutouts formed in a pattern thereon, and an abrading belt trained over the sleeve; rotating the contact roll of the first abrading assembly while simultaneously oscillating the contact roll of the first abrading assembly in a first direction via a linear reciprocating motion; abrading a top surface of the floor structure with the first abrading assembly; rotating the contact roll of the second abrading assembly while simultaneously oscillating the contact roll of the second abrading assembly in a second direction via a linear reciprocating motion; and abrading the top surface of the floor structure with the second abrading assembly.

DETAILED DESCRIPTION OF THE EMBODIMENT(S)

Figure 1:
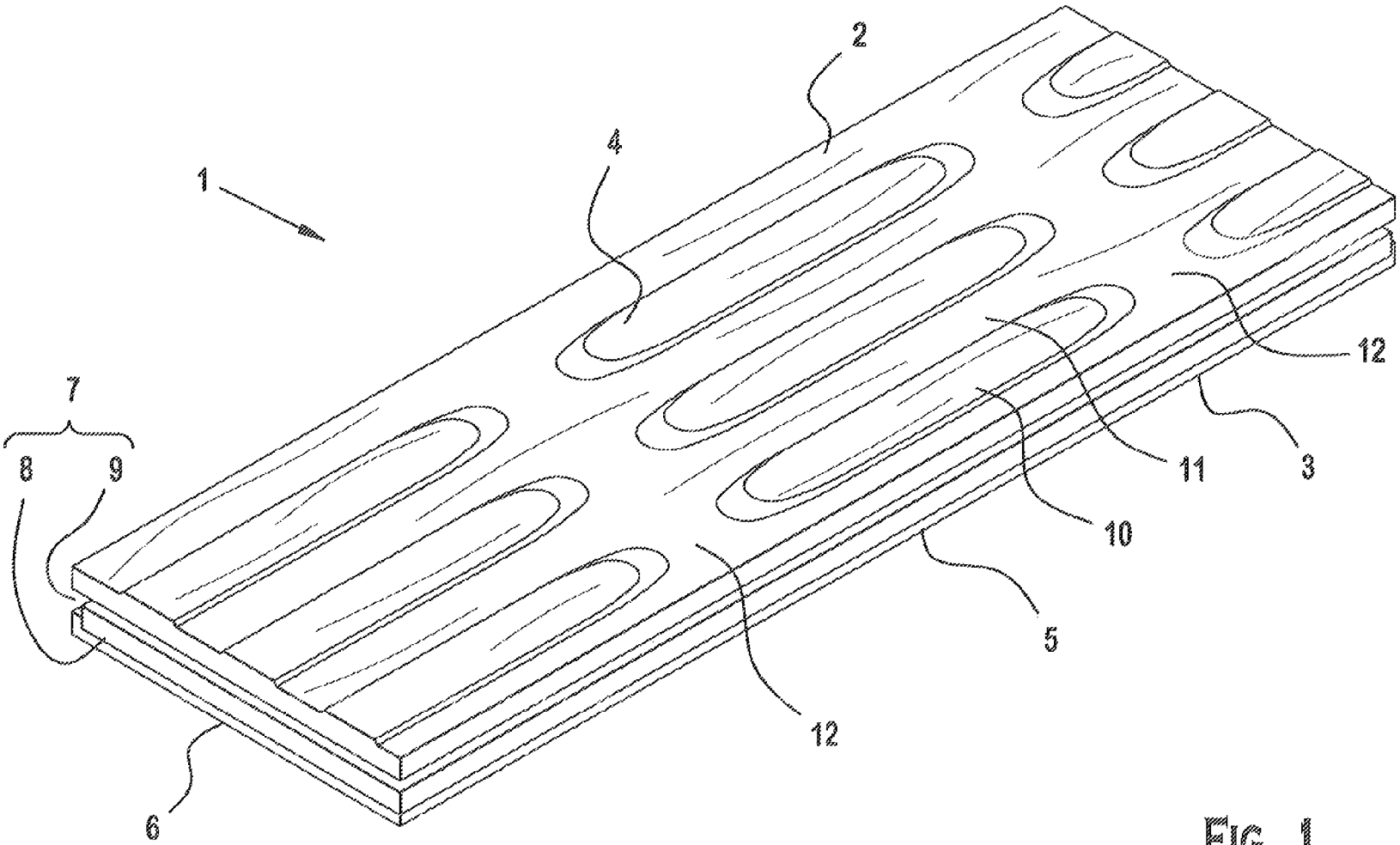
FIG. 1 is a perspective view of a floor structure according to an embodiment of the invention.

FIG. 1 shows a floor structure 1 according to an embodiment of the present invention. The floor structure 1 may be a single ply of solid or engineered hardwood or multiple plies of solid and/or engineered hardwood laminated together. As shown in FIG. 1, the floor structure 1 comprises a top surface 2 and a bottom surface 3. The top surface 2 has a substantially continuous distressed visible pattern 4 formed therein. In the embodiment shown and described herein, the distressed visible pattern 4 comprises a plurality of substantially parallel raised portions 10 and recessed portions 11, which are intermittent at varying locations 12. First and second opposing side surfaces 5, 6 extend substantially perpendicular to the top surface 2 and the bottom surface 3. The first and/or second opposing side surfaces 5, 6 are optionally provided with a locking member 7. The locking member 7 may comprise, for example, a tongue 8 and a groove 9. The tongue 8 and the groove 9 may optionally be provided with locking projections (not shown) and locking recesses (not shown). Because locking members for floor structures are well known in the art, further description thereof has been omitted. Further, it will be appreciated by those skilled in the art that although the floor structure 1 is shown and described herein as having a substantially rectangular or plank shape, that the floor structure 1 could be square or any other geometrical configuration.

Figure 2:
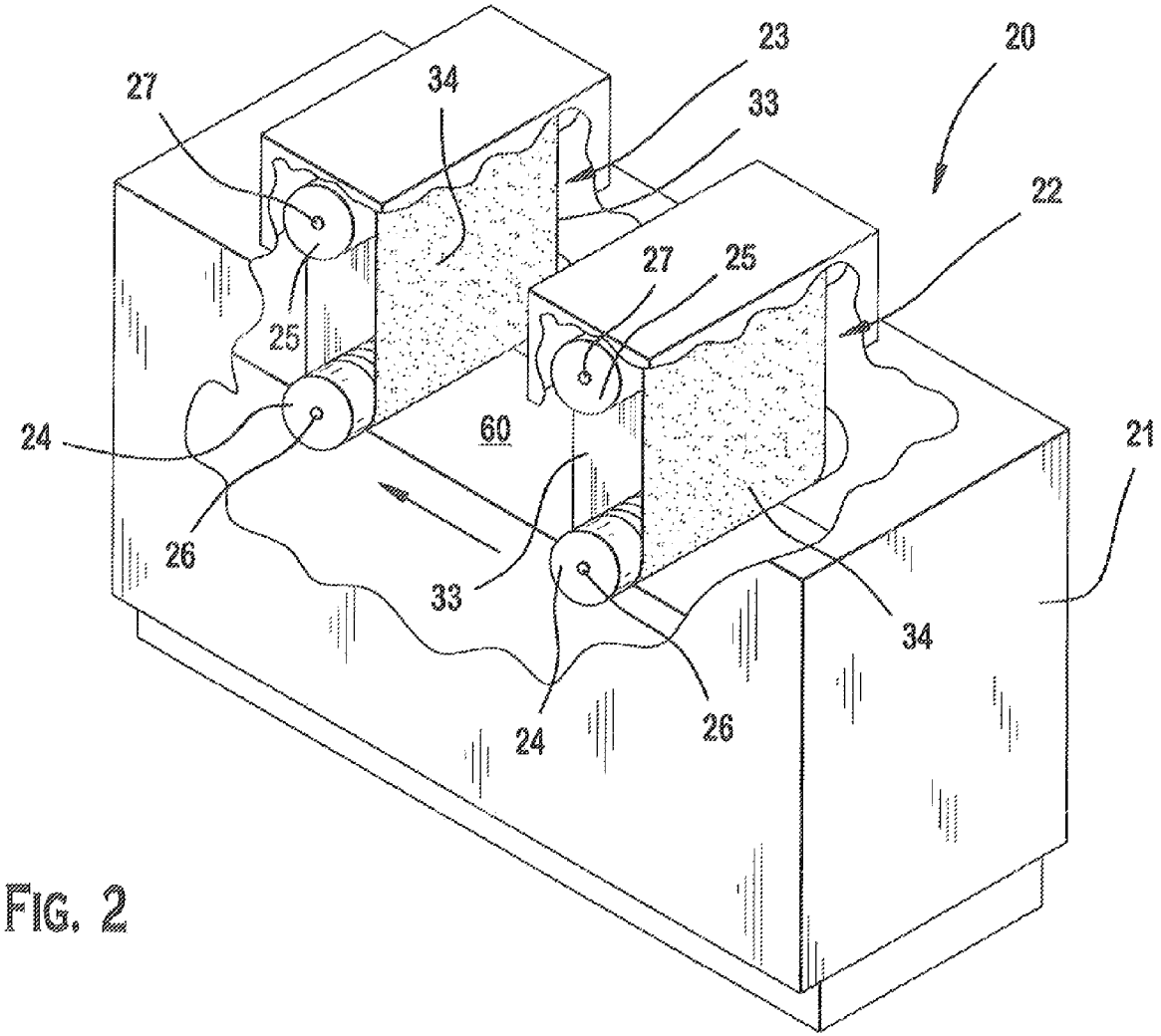
FIG. 2 is a diagrammatic view in partial cut-away of an abrading device according to an embodiment of the invention.

FIG. 2 shows an abrading device 20 for providing the distressed visible pattern 4 on the top surface 2 of the floor structure 1. Because the general structure of the abrading device 20 described herein is well known in the art, only the improvements thereto with respect to providing the distressed visible pattern 4 on the top surface 2 of the floor structure 1 will be described in further detail herein. Examples of conventional abrading devices having the general structure of the abrading device 20 described herein are sold, for example, by Timesavers, Inc. located in Maple Grove, Minn.

As shown in FIG. 2, the abrading device 20 comprises a housing 21 containing a first abrading assembly 22 and a second abrading assembly 23. The first abrading assembly 22 and the second abrading assembly 23 each comprise a contact roll 24 spaced from and positioned substantially underneath an idler roll 25. The contact roll 24 and the idler roll 25 are mounted on substantially parallel shafts 26, 27, respectively, which are supported by a frame 35 (FIG. 3) of the housing 21. The contact roll 24 and the idler roll 35 have a length in a longitudinal direction of about 52 inches. The contact roll 24 of the first abrading assembly 22 has a radius smaller than a radius of the contact roll 24 of the second abrading assembly 23. The contact roll 24 of the first abrading assembly 22 has a radius, for example, of about 7 inches, and the contact roll 24 of the second abrading assembly 23 has a radius, for example, of about 16.5 inches.

Figure 3:
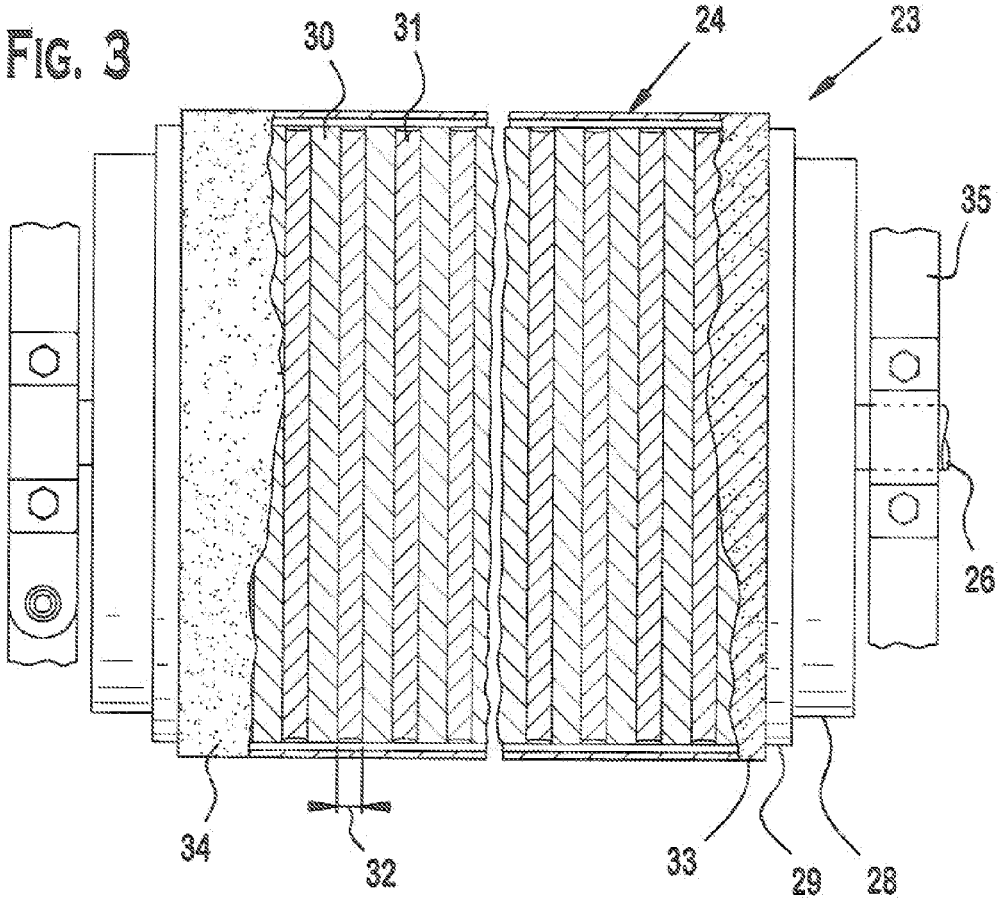
FIG. 3 is a diagrammatic view in partial cut-away of a contact roll of a first abrading assembly and a contact roll of a second abrading assembly of the abrading device.
Figure 3:
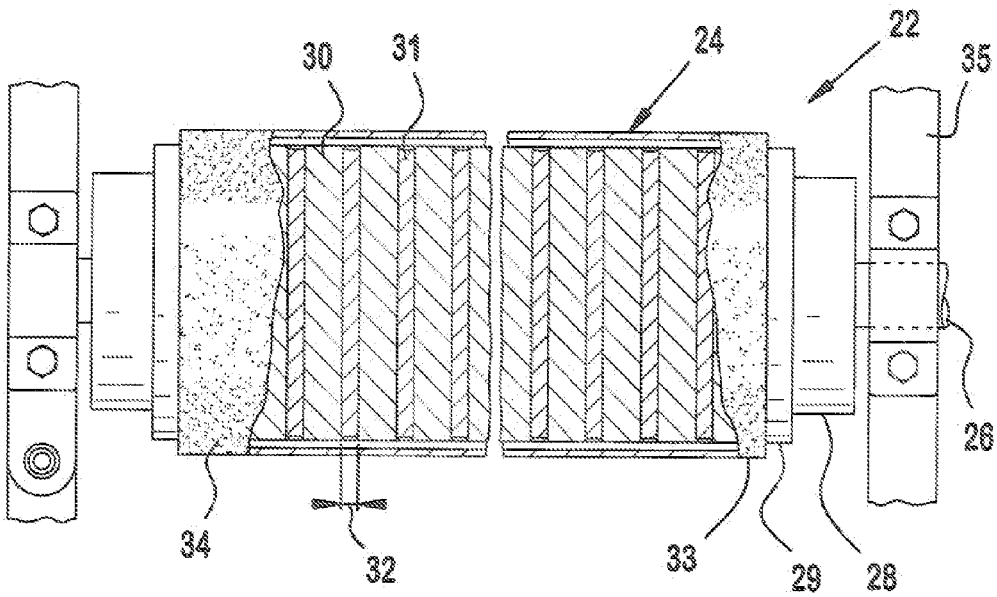

As shown in FIG. 3, each of the contact rolls 24 consists of a cylindrical core 28 configured to axially receive the shaft 26. The core 28 may be formed, for example, from steel tubing. A sleeve 29 encompasses the core 28. The sleeve 29 may be formed from steel, hard plastic, or a rubber material, such as urethane rubber. The sleeve 29 is provided with a plurality of equally spaced and substantially parallel inclined grooves 30 that extend radially about the sleeve 29. The grooves 30 permit radial expansion of the sleeve 29 in response to centrifugal force and dissipate heat. The sleeve 29 is also provided with a plurality of equally spaced and substantially parallel cutouts 31 that extend radially about the sleeve 29 in a direction substantially perpendicular to a longitudinal direction of the sleeve 29. The cutouts 31 are substantially concave in shape and form a substantially scalloped pattern along the longitudinal direction of the sleeve 29. The cutouts 31 are machined into the sleeve 29 over top of the grooves 30.

In the illustrated embodiment, the cutouts 31 of the contact rolls 24 of the first abrading assembly 22 and the second abrading assembly 23 have a depth of about 0.015-0.020 inches. The cutouts 31 of the contact roll 24 of the first abrading assembly 22 have a width 32 smaller than a width 32 of the cutouts 31 of the second abrading assembly 23. For example, the width 32 of the cutouts 31 of the contact roll 24 of the first abrading assembly 22 is about 1.0 inch, and the width of the cutouts 31 of the contact roll 24 of the second abrading assembly 23 is about 1.5 inches. It will be appreciated by those skilled in the art that the length of the contact rolls 24, the radius of the contact rolls 24, the shape of the cutouts 31, the depth of the cutouts 31 and/or the width 32 of the cutouts 31 may be varied depending on the desired appearance of the distressed visible pattern 4 formed on the top surface 2 of the floor structure 1.

As shown in FIG. 2, an abrading belt 33, is trained over the contact roll 24 and the idler roll 25. The abrading belt 33 is tensioned between the contact roll 24 and the idler roll 25, for example, by an actuator (not shown) that moves the idler roll 25 towards and away from the contact roll 24. Because actuators are well known in the art with respect to abrading devices, further description thereof has been omitted. The abrading belt 33 is configured such that the abrading belt 33 substantially covers the contact roll 24 and the idler roll 25. The abrading belt 33 may have a width 32, for example, of about 60 inches and a length, for example, of about 48 inches. The abrading belt 33 is provided with an abrading material 34. In the illustrated embodiment, the abrading belt 33 is, for example, sandpaper having a grit size of about 80-240, and preferably about 120. It will be appreciated by those skilled in the art, however, that the material used for the abrading belt 33, the material used for the abrading material 34, the size of the abrading material 34, and the bond between the abrading belt 33 and the abrading material 34 may be varied depending on the desired appearance of the distressed visible pattern 4 formed on the top surface 2 of the floor structure 1.

Figure 4:
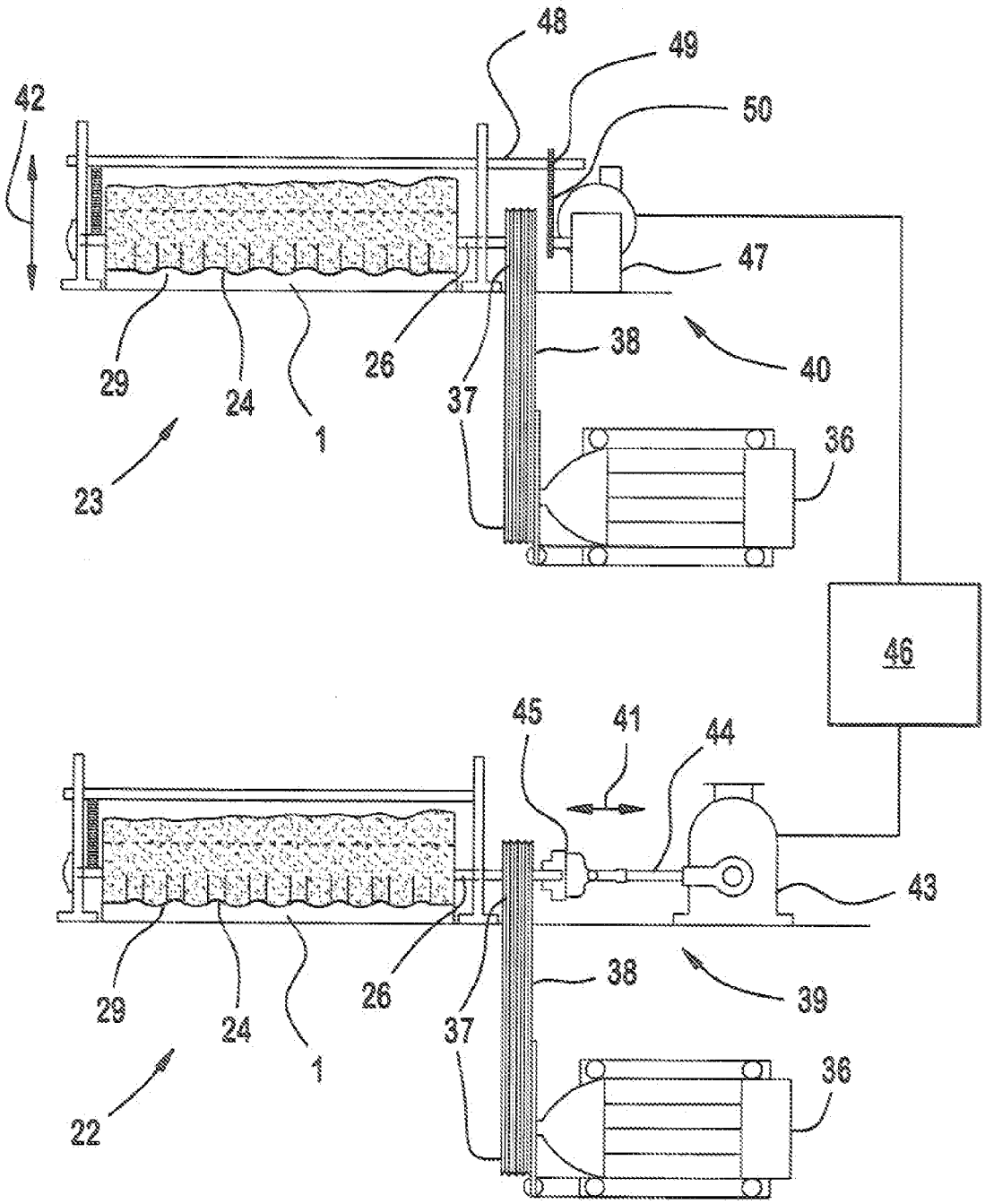
FIG. 4 is diagrammatic view of a first oscillation assembly and a second oscillation assembly of the abrading device.

As shown in FIG. 4, the first abrading assembly 22 and the second abrading assembly 23 are each rotationally driven by a drive motor 36 which is coupled to the shaft 26 of the contact roll 24 via drive pulleys 37 and a drive belt 38. The first abrading assembly 22 and the second abrading assembly 23 are further provided with a first oscillation assembly 39 and a second oscillation assembly 40, respectively. The first oscillation assembly 39 is configured to oscillate the first abrading assembly 22 in a first direction 41 substantially parallel to the longitudinal direction of the sleeve 29 via a linear reciprocating motion. The second oscillation assembly 40 is configured to oscillate the second abrading assembly 23 in a second direction 42 substantially perpendicular to the longitudinal direction of the sleeve 29 via a linear reciprocating motion. In the illustrated embodiment, the first direction 41 is substantially perpendicular to the second direction 42. It will be appreciated by those skilled in the art that there are many conventional methods that can be employed to oscillate the first abrading assembly 22 in the first direction 41 and the second abrading assembly 23 in the second direction 42. For example, in the embodiment shown and described herein, the first abrading assembly 22 and the second abrading assembly 23 are each oscillated via a linear slide. However, other oscillation mechanisms could be used, such as a linear bearing mechanism.

As shown in FIG. 4, the first abrading assembly 22 is oscillated in the first direction 41 via the first oscillation assembly 39, which comprises a variable frequency drive 43 having a cam arm 44 extending there from. The cam arm 44 is attached to the shaft 26 via a cam bearing 45. The cam bearing 45 has an offset of about 0.75 inches such that for every one revolution of the shaft 26 the contact roll 24 is driven about 0.75 inches in the first direction 41. A programmable logic controller 46 is connected to the variable frequency drive 43 of the first oscillation assembly 39. The programmable logic controller 46 controls the timing sequence (whether variable or deliberate) and the speed at which the first abrading assembly 22 is oscillated in the first direction 41.

The second abrading assembly 23 is oscillated in the second direction 42 via the second oscillation assembly 40, which comprises a variable frequency drive 47 coupled to a cam shaft 48 via sprockets 49 and a cam chain 50. The contact roll 24 is driven in the second direction 42 by the eccentric about 0.007-0.012 inches. The programmable logic controller 46 is connected to the variable frequency drive 47 of the second oscillation assembly 40. The programmable logic controller 46 controls the timing sequence (whether variable or deliberate) and the speed at which the second abrading assembly 23 is oscillated in the second direction 42.

As shown in FIG. 1, a conveyor belt 60 is arranged underneath the contact rolls 24 of the first abrading assembly 22 and the second abrading assembly 23. The conveyor belt 60 is supported below the contact rolls 24 by a platen (not shown). A displacement member (not shown) for effecting relative movement between the contact rolls 24 and the platen (not shown) may be further provided beneath the first abrading assembly 22 and the second abrading assembly 23. The displacement member (not shown) is configured to accommodate for different thicknesses of the floor structure 1. Because conveyor belts, platens, and displacement members are well known in the art with respect to abrading devices, further description thereof has been omitted.

Figure 5:
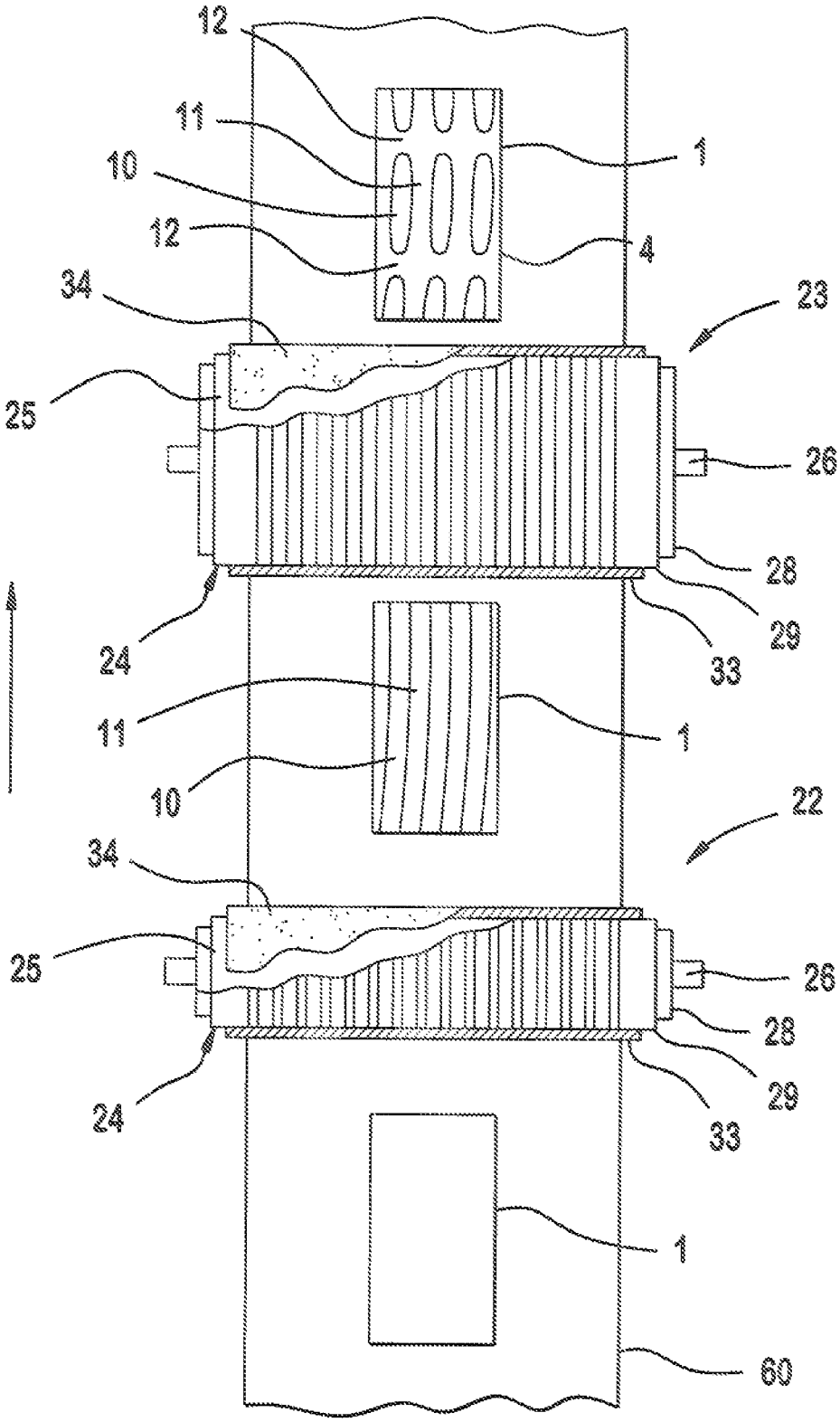
FIG. 5 is a diagrammatic view of a method of forming the floor structure using the abrading device.

A method for providing the distressed visible pattern 4 on the top surface 2 of the floor structure 1 utilizing the abrading device 20 will now be described in greater detail. As shown in FIG. 5, at least one of the floor structures 1 is advanced by the conveyor belt 60 toward and underneath the contact roll 24 of the first abrading assembly 22 such that the top surface 2 of the floor structure 1 has tangential contact with the abrading belt 33 of the first abrading assembly 22. As the abrading belt 33 contacts the top surface 2 of the floor structure 1, the abrading belt 33 deflects into the cutouts 31. As a result, as the contact roll 24 rotates, the abrading belt 33 removes material on the top surface 2 of the floor structure 1 in a pattern corresponding to the pattern formed on the sleeve 29 by the cutouts 31. For example, in the embodiment shown and described herein, a plurality of substantially parallel raised portions 10 and substantially parallel recessed portions 11 are formed on the top surface 2 of the flooring structure 1, wherein the width, height, and location of the raised portions 10 substantial correspond to the width 32, depth, and location of the cutouts 31 on the sleeve 29. Simultaneously, the contact roll 24 is oscillated in the first direction 41 by the first oscillation assembly 39 in response to a signal from the programmable logic controller 46. In the illustrated embodiment, the contact roll 24 is oscillated in a direction substantially parallel to the top surface 2 of the floor structure 1. Thus, the oscillation of the contact roll 24 causes the pattern being formed on the top surface 2 of the floor structure 1 to deviate in the first direction 41. As a result, in the embodiment shown and described herein, the substantially parallel raised portions 10 are inclined in the first direction 41. The amount and timing of the deviation corresponds to the signal from the variable frequency drive 43.

Next, the floor structure 1 is advanced by the conveyor belt 60 toward and underneath the contact roll 24 of the second abrading assembly 23 such that the top surface 2 of the floor structure 1 is in alignment with the contact roll 24. As the floor structure 1 is advanced, the contact roll 24 is oscillated in the second direction 42 by the second oscillation assembly 40 in response to a signal from the programmable logic controller 46. In the illustrated embodiment, the contact roll 24 is oscillated in a direction substantially perpendicular to the top surface 2 of the floor structure 1. As a result, the abrading belt 33 comes into and out of contact with the top surface 2 of the floor structure 1. When the abrading belt 33 contacts the top surface 2 of the floor structure 1, the abrading belt 33 deflects into the cutouts 31. As a result, as the contact roll 24 rotates, the abrading belt 33 removes material on the top surface 2 of the floor structure 1 in a pattern corresponding to the pattern formed on the sleeve 29 by the cutouts 31. For example, in the embodiment shown and described herein, because the top surface 2 of the floor structure 1 already has the raised portions 10 and the recessed portions 11 formed therein, the abrading belt 33 mainly removes material from the raised portions 10 to cause the raised portions 10 to be intermittent at the varying locations 12 with respect to a longitudinal direction of the floor structure 1. The amount and timing of the contact of the abrading belt 33 with the top surface 2 of the floor structure 1 corresponds to the signal from the variable frequency drive 43.

As shown in FIG. 5, after the floor structure 1 exits the abrading device 20, the top surface 2 of the floor structure 1 has the distressed visible pattern 4 formed thereon. The abrading device 20 shown and described herein therefore quickly and cost effectively abrades the top surface 2 of the floor structure 1 to provide an authentic distressed appearance on the top surface 2 thereof. After the distressed visible pattern 4 is formed on the floor structure 1, the floor structure 1 may optionally be run through a finishing line (not shown) where stains and/or top coats, for example, can be applied to the top surface 2 of the floor structure 1.

The foregoing illustrates some of the possibilities for practicing the invention. Many other embodiments are possible within the scope and spirit of the invention. For example, the teachings herein with respect to the abrading device 20 are not solely limited to floor structures. It will be appreciated by those skilled in the art that the abrading device 20 could also be used to provide the distressed visible pattern 4 on other wood or wood-like structures, such as wall or furniture structures. It is, therefore, intended that the foregoing description be regarded as illustrative rather than limiting, and that the scope of the invention is given by the appended claims together with their full range of equivalents.

What is claimed is:

1. An abrading device for providing a distressed visible pattern on a top surface of a floor structure, comprising:

a first abrading assembly and a second abrading assembly, the first and second abrading assemblies each having a rotationally driven contact roll and an idler roll, the contact roll being provided with a sleeve having a plurality of cutouts formed in a pattern thereon, and an abrading belt comprising an abrasive material trained over the sleeve of the contact roll and idler roll;

a first oscillation assembly connected to the first abrading assembly that oscillates the contact roll of the first abrading assembly in a first direction via a linear reciprocating motion; and a second oscillation assembly connected to the second abrading assembly that oscillates the contact roll of the second abrading assembly in a second direction via a linear reciprocating motion, wherein the second direction is different than the first direction;

wherein the contact roll of the second abrading assembly is configured and operable to form an intermittent distressed visible pattern on the floor structure; and wherein the first and second oscillation assemblies are configured to operate independently so as to oscillate the contact roll of the first abrading assembly in the first direction while oscillating the contact roll of the second abrading assembly in the second direction respectively.

2. The abrading device of claim 1, wherein the first direction is substantially perpendicular to the second direction.

3. The abrading device of claim 1, wherein the first direction is substantially parallel to a longitudinal direction of the sleeve and the second direction is substantially perpendicular to a longitudinal direction of the sleeve.

4. The abrading device of claim 1, wherein the first and second abrading devices are consecutively arranged.

5. The abrading device of claim 1, wherein the contact roll of the first abrading assembly has a smaller radius than a radius of the contact roll of the second abrading assembly.

6. The abrading device of claim 1, wherein the cutouts extend radially about the sleeve in a direction substantially perpendicular to a longitudinal direction of the sleeve.

7. The abrading device of claim 1, wherein the cutouts have a depth of about 0.015-0.020 inches.

8. The abrading device of claim 1, wherein the cutouts are substantially concave in shape and form a substantially scalloped pattern along a longitudinal direction of the sleeve.

9. The abrading device of claim 1, wherein the cutouts in the sleeve of the first abrading assembly have a width smaller than a width of the cutouts in the sleeve of the second abrading assembly.

10. The abrading device of claim 9, wherein the cutouts in the sleeve of the first abrading assembly have a width of about 1.0 inch and the cutouts in the sleeve of the second abrading assembly have a width of about 1.5 inches.

11. A method for providing a distressed visible pattern on a floor structure, comprising:

a) providing a first abrading assembly and a second abrading assembly, the first and second abrading assemblies each having a rotationally driven contact roll, the contact roll being provided with a sleeve having a plurality of cutouts formed in a pattern thereon, and an abrading belt trained over the sleeve;

b) rotating the contact roll of the first abrading assembly while simultaneously oscillating the contact roll of the first abrading assembly in a first direction via a linear reciprocating motion;

c) abrading a top surface of the floor structure with the first abrading assembly while performing step b);

d) rotating the contact roll of the second abrading assembly while simultaneously oscillating the contact roll of the second abrading assembly in a second direction via a linear reciprocating motion, wherein the first direction is different than the second direction, wherein the contact roll of the second abrading assembly comes into and out of contact with the top surface of the floor structure;

e) intermittently abrading the top surface of the floor structure with the second abrading assembly to produce an intermittent distressed pattern on the floor structure while performing step d); and wherein steps c) and d) are performed concurrently on different positions of the floor structure.

12. The method of claim 11, wherein the first direction is substantially perpendicular to the second direction.

13. The method of claim 11, wherein the first direction is substantially parallel to a longitudinal direction of the sleeve and the second direction is substantially perpendicular to a longitudinal direction of the sleeve.

14. The method of claim 11, wherein the contact roll of at least one of the first and second abrading assemblies is randomly oscillated by a variable frequency drive.

15. The method of claim 11, wherein the contact roll of the first abrading assembly has a smaller radius than a radius of the contact roll of the second abrading assembly.

16. The method of claim 11, wherein the cutouts extend radially about the sleeves in a direction substantially perpendicular to a longitudinal direction of the sleeve.

17. The method of claim 11, wherein the cutouts have a depth of about 0.015-0.020 inches.

18. The method of claim 11, wherein the cutouts are substantially concave in shape and form a substantially scalloped pattern along a longitudinal direction of the sleeve.

19. The method of claim 11, wherein the cutouts in the sleeve of the first abrading assembly have a width smaller than a width of the cutouts in the sleeve of the second abrading assembly.

20. The method of claim 19, wherein the cutouts in the sleeve of the first abrading assembly have a width of about 1.0 inch and the cutouts in the sleeve of the second abrading assembly have a width of about 1.5 inches.

* * * * *